United States Patent [19]

af Strom

[11] Patent Number: 5,020,802

[45] Date of Patent: Jun. 4, 1991

[54] GOLF TRAINING DEVICE AND METHOD

[76] Inventor: Oscar R. F. af Strom, Ave. Residencial Chiluca 207, Club Campestre Chiluca, Atizapan, Mexico

[21] Appl. No.: 507,003

[22] Filed: Apr. 10, 1990

Related U.S. Application Data

[63] Continuation-in-part of Ser. No. 413,113, Sep. 27, 1989, abandoned.

[51] Int. Cl.[5] ..... A63B 69/36

[52] U.S. Cl. ..... 273/185 R; 273/181 K; 273/176 L; 273/176 FA; 273/201

[58] Field of Search ..... 273/176 F, 176 FA, 176 FB, 273/176 B, 176 AB, 176 R, 176 L, 185 R, 185 A, 185 B, 184 R, 181 R, 182 R

[56] References Cited

U.S. PATENT DOCUMENTS

| | | | |
|---|---|---|---|
| 1,657,913 | 1/1928 | Barnett | 273/181 K |
| 3,128,627 | 4/1964 | Harris | 273/181 K |
| 3,516,675 | 6/1970 | Kuester et al. | 273/181 K |
| 3,524,649 | 8/1970 | Conklin et al. | 273/181 K |

OTHER PUBLICATIONS

"The Columbia Encyclopedia", Third Edition, 1963, pp. 2025–2026.

*Primary Examiner*—George J. Marlo
*Attorney, Agent, or Firm*—John D. Upham

[57] ABSTRACT

A golf training device and method giving instantaneous feedback of the quality of the shot. Two opposite, substantially parallel walls are provided between which the golfer stands with his club and a light-weight training ball. Each wall is marked with a grid on the side facing the other wall. The golfer strikes the ball with a driver or approach club towards the front wall. By observing, visually or electronically, where the ball strikes the wall or walls and the floor, the direction and distance of flight are ascertained, against which can be compared subsequent shots in order to determine consistency and improvement. The device and method may be used for various competitions.

25 Claims, 7 Drawing Sheets

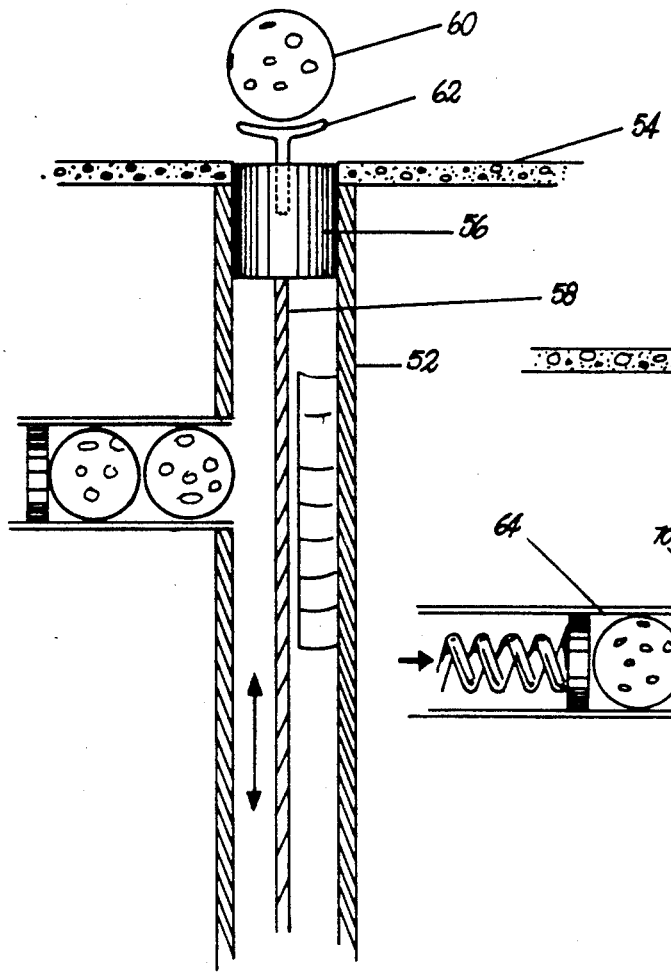
FIG. 11-A
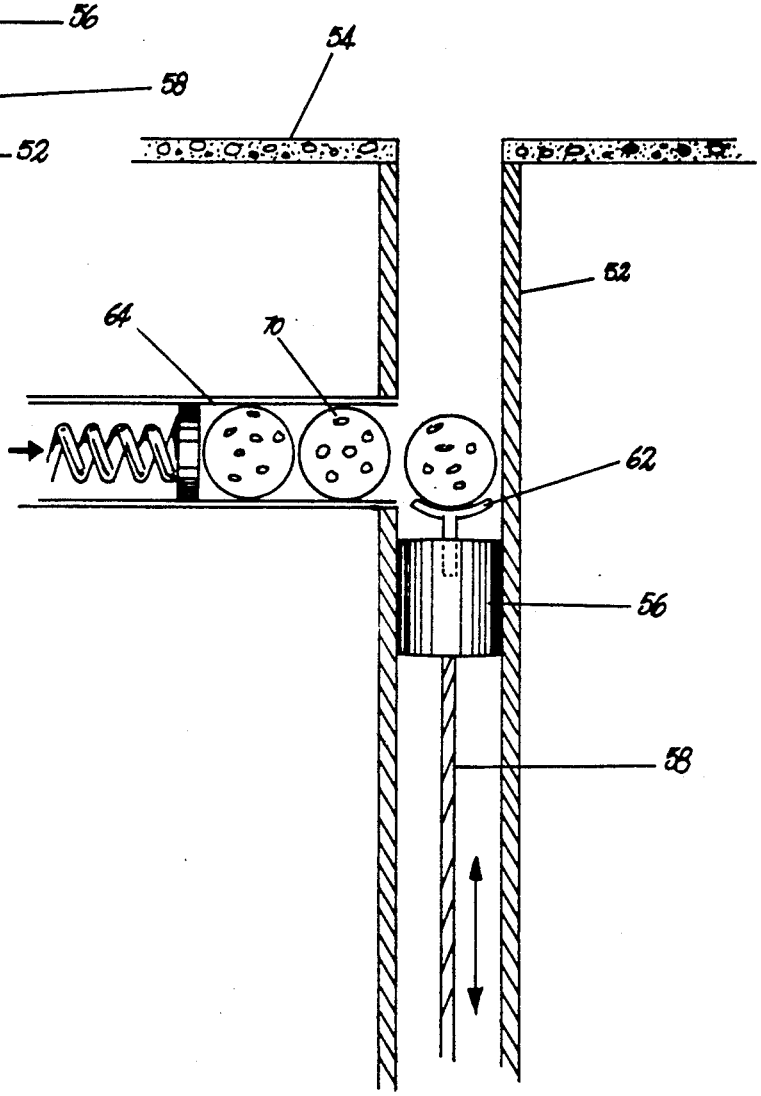
FIG. 11-B

GOLF TRAINING DEVICE AND METHOD

This application is a continuation-in-part of application Ser. No. 07/413,113, filed Sept. 27, 1989, now abandoned.

BACKGROUND OF THE INVENTION

Golf is a sport which requires much practice, because the golf swing is not a natural movement. Over the years master golfers have laid down rules for practically every aspect and phase of the swing, and the resultant combination of movements constitutes the ideal golf swing, which most persons will need to learn step by step over a long period of time, before reaching a standard of proficiency. Naturally, there is no such thing as one agreed upon golf swing, as various master golfers have derived different systems.

Because of the complex movements involved in a golf swing, a player is forced to practice constantly, in order to keep up his standard. Long periods without practice may result in a marked decrease in standard of play. Therefore, after long breaks, such as a winter, a player is required to start the new season by practicing his swing, before he will be able to play at the same level he possessed at the end of the previous season.

Because of this special requirement for practice, a number of facilities have been developed to satisfy this need, as have various devices to aid in the learning of the golf swing.

The best facility for practicing is a golf course itself, if a player has the opportunity to play repeated shots from the teeing grounds and to the greens. However, as courses are often crowded, such practice is difficult to obtain. Instead, the golfer may practice on special driving ranges and practice grounds. He or she may also hit balls into a net, or balls fixed to wire strings. Lately, a hightech electronic aid has been developed which enables a golfer to obtain quantitative as well as qualitative information about his swing.

There are also light weight plastic balls which travel between 20 and 60 yards, and offer a faithful replica of the flight of a real ball. Among other training devices are clubs which, when swung, record the clubhead speed, and those with a mechanism responding to the centrifugal force. At a certain clubhead speed, the centrifugal force acts on a ball inside the shaft, which in turn results in an audible click, thereby informing the player that he has reached the required clubhead speed to cause a ball to travel a certain distance.

While all of these methods give the golfer a good opportunity to hit full shots, they do not provide the required distinction between shots of different length and direction. For instance, it is difficult to determine the quality of shots hit on a driving range, because the differences in distance and direction are difficult to judge from a distance of 2-300 yards.

As regards hitting balls towards a net, or a ball on a wire string or some similar device, the golfer does not get information as to the distance or direction of the shot. Best information in this respect is obtained from the flight of a light weight plastic ball. However, the required area to accommodate shots between 20 and 60 yards does not make full shot practice possible in a backyard garden, or indoors. As regards the hightech device mentioned above, this is probably the best aid existing. It provides information as to distance, direction, trajectory and clubhead velocity in digital form.

While the hightech device, as well as a ball on a wire string, or a golf net may be used indoors during the off season, as may the clubs with devices related to the clubhead speed, the other methods where a ball in flight may be observed may only be used outdoors, or in large indoor tents or special buildings. This is unfortunate, because the best training value would be of the shot in the shape of a trajectory of a ball in flight including direction and distance, thereby providing positive or negative re-inforcements of the action, which is so important in the learning process.

Ideally, the practicing golfer should be able to receive instantly the same information he receives when he looks up after execution of a real golfshot, as to trajectory of the flight of the ball, together with the information he later on receives by walking up to his shot and observing the position of the ball. As said above, the latter information is not available to the golfer on the driving range, because of the distance involved. It is not even available instantly on the golf course, as there is a time lag between the shot itself and the viewing of the result, i.e. the position of the ball. The hightech device provides this information digitally, but not in the desired analogue form which gives the required instant feedback. There is no facility or device available to the golfer, which provides both of these parameters simultaneously, neither one for outdoor nor one for indoor use.

The present invention has been derived with a view to obtaining a training device which satisfies the above mentioned ideal requirement. One aim of the invention has been to provide a facility and a device by which it will be possible to obtain instant feedback related to the flight path of a ball.

A second objective has been to provide a facility where instant and visible information may be provided as to the direction and distance of a golf shot with a high degree of precision. A further aim of this invention has been to provide said facility for golf training within a limited space in order that it may be accommodated in a backyard or garden of a private home or indoors in golf training "cubicles".

THE INVENTION

This invention is based on the principle that light plastic balls may be hit against a wall and bounce back. This principle is sometimes utilized by golfers who practice with such balls. However, this kind of practice is only used for short approach shots, involving touch and feel rather than force.

While light touch approach shots, so called chips and pitches, are useful from the fringe of the green, and thus must be practiced, most amateur golfers end up short of the hole from positions located between the fringe of the green and some 50 to 75 yards away, because they use too light a touch instead of a reduced swing with normal force, or a full swing with a reduced radius, which may be achieved by shortening the club shaft. This invention does not exclude light touch practice, but the main aim has been to provide a facility for practicing full swing shots and the utilization of controlled force.

For this purpose, there are provided two vertical walls, preferably substantially parallel, opposite each other and at a distance apart equal, more or less, to one third of the distance a light-weight plastic ball the size of a golf ball will travel in the air if hit with a driving club by a scratch golfer. However, to accommodate all classes of golfers, the distance between the two walls may be made variable. A practicing golfer may position himself anywhere between the two walls, hitting light weight plastic balls towards the front wall. The ball will hit the front wall and bounce back towards the rear wall. If the shot was well executed, the ball will then hit the rear wall and bounce back towards the golfer. If the shot was very well executed, the ball will bounce back from the rear wall to the position of the practicing golfer, or beyond him. A champion golfer may be able to hit the ball so hard that it bounces back to the front wall, hitting it a second time, and from there back towards the golfer's position. However, the distance between the walls ought to be long enough so as to make such extremes very rare. Preferably the rear wall is higher than the front wall.

The walls, and preferably also the ground, are provided with a rectangular, preferably square, or polar grid, thereby making it possible to determine, with exactitude, the direction and distance a ball has travelled. The size of each square or other grid space is chosen so that the golfer can readily perceive which space(s) is struck by the ball. Conveniently a square may be about 5 inches by 5 inches, and other shaped spaces may be of similar area. The ground (floor) between the walls would normally be flat, but may be inclined for the purpose of practicing uphill, downhill and hanging lies of the ball. The grids are on the sides of the walls that face each other. Those sides should be smooth to assure consistent bounce.

The training device may be used by any category of golfers, including complete beginners. The latter group would probably be better off with this device, than on a practice ground or driving range. In the very early stage, the beginner would learn the basic elements of the golf swing, including the difficult left arm rotation, clockwise during the backswing and anti-clockwise during the down swing. To practice this, he or she would only require the two walls, one to hit against and the second one to stop the ball. He would not require any markings on the walls for this practice, and would preferably use a bigger ball than a golf ball during the very first hours of practice, for instance a tennis ball.

When the student has learned the basic swing movement, the next stage would be to learn to swing with full force. At that stage, should he or she also concentrate on direction?. There are different opinions about this. One school of thought argues that the beginning golfer better learns to hit the ball hard before starting to concentrate on direction. Representatives of this school are of the opinion that direction of the shots could easily be learned with simple adjustments of the swing, while the reverse, i.e. learning to hit the ball hard at a later stage would be much more difficult to accomplish. Both Jack Nicklaus and Arnold Palmer are said to have learned to hit the ball hard before concentrating on direction.

For golfers who would like to learn to swing hard from the beginning, the next step would be to practice to hit the ball as hard as possible. Ideal for such practice is to hit a slow squash ball towards a wall. Even for this kind of practice, only the two walls would be required, without any necessity to mark them for purpose of direction. Neither would markings on the floor be needed, as the ball does not fly very far, and moves rather slowly. Thus the player could easily observe the general area where the ball bounces and lands, and compare the relative distance of his shots.

This kind of practice is not only of value to beginners. Even seasoned golfers who want to loosen up their swing, before concentrating on direction, may like to practice in that area of the training device.

For golfers who want to learn the swing in the conservative manner, i.e. to learn to drive the ball in a desired direction from the very start, in the basic mode the beginner would mainly concentrate on hitting straight balls to the best of his ability, improving the swing and thus clubhead speed and distance as he continues to practice in accordance with learning directives received from a teacher, a video presentation, a book, or a magazine article.

In a later mode, he would concentrate on distance as well as direction, by directing straight shots towards one of the squares on the front wall, located on the axis of symmetry, as well as towards squares located on the side of said axis. The result as regards direction may be measured on the front wall, but as distance is also involved, it should preferably be measured on the rear wall. The grid spaces may be visually distinguished from each other, as by numbers, letters and/or colors.

It is sufficient to sight the bounce of the ball, on the front wall and/or the rear wall and/or the floor. The walls may be constructed so that when a grid space is hit it flips or lights up. This may also be recorded and displayed by electrical impulses.

At this stage, the golfer is still concentrating on straight shots. A ball hit straight to the front wall will bounce back along a straight line, eventually hitting the rear wall somewhere on a vertical column of squares. Where it hits the column, i.e. how high above the ground, depends on the backspin or topspin of the ball, resulting from the shot.

In a third mode, the golfer will also hit balls towards the front wall, though with side spin, either a so called hook spin, or a so called slice spin applied to the ball. This will result in a different bounce and trajectory of the ball, which will hit a different square on the back wall than if it would have been hit straight. In such a manner, it will be possible for the golfer to practice and compare sequential shots and thus improve his consistency and ability to hit straight balls, as well as balls with side spin. The result can be measured with precision.

Interesting competitions may be conducted, such as driving contests, ball nearest to a designated square on the back wall, or simulated stroke play or match play tournaments. For such competitions the floor may be marked to show one or more positions at which a golfer is to stand or the contestants may be allowed to choose their own positions. Floor position markers may also be helpful to beginners.

When players are likely to stand in only a few spots or at position markers it is convenient to provide means to supply, after each shot, a fresh ball on a tee. For example, a tee holder may be mounted in a vertical tube in the ground and automatically fed from reservoir(s) a fresh tee and ball which are then raised into position. Once the shot is off the tee holder is automatically retracted, refitted and raised again into position.

By "light training ball" or "light practice ball" I mean a ball that is much lighter in weight than a golf ball, so that when struck a full blow by a golf club it will have less momentum and will travel a much shorter distance. In order to have a good fit with the face of the golf club it should not deviate a great deal from the size of a golf ball. Such practice balls may be purchased at many sporting goods stores for less than a dollar. One such is hollow white hard plastic with dimples simulating the appearance of a golf ball. Another is hollow orange somewhat rubbery plastic with 26 holes ¼ inch diameter. Another is yellow nerf with a ¾ inch red spot and a hard core inside which makes a shot sound like the hit of a real ball. The first has the longest life span, several hundred up to perhaps a thousand shots. The second does not last as long. Both finally split. The third tears. All are of about the same diameter as a golf ball. Plastic practice balls may be made of high impact polystyrene, ABS, polyethylene, polypropylene, nylon, or any plastic material sufficiently tough to withstand repeated blows. An excellent ball for practice is a "slow" squash ball. This is a hard hollow rubber ball, a little smaller than a golf ball. It lasts longer than the balls mentioned above. For games the first two balls are preferred.

THE DRAWINGS

FIG. 11A is a sectional view of a device holding a tee and ball in place at floor level.

FIG. 11b is a sectional view of the device of FIG. 11A retracted to be supplied with a fresh ball.

DETAILED DESCRIPTION

Figure 1:
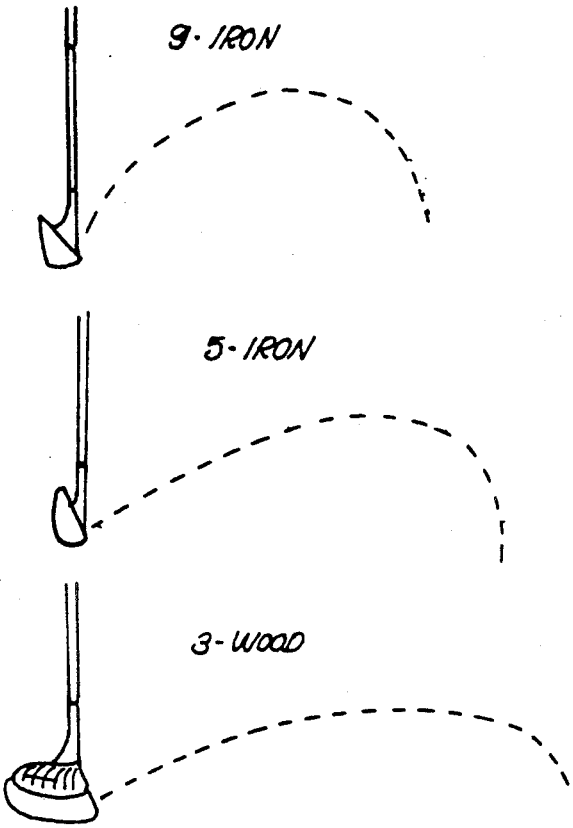
FIG. 1 shows the trajectory of golf shots with different clubs.

FIG. 1 is a copy of a figure which appeared in the March, 1989 issue of Golf Digest Magazine, showing the trajectories of golf balls hit with a 9-iron (approach club), a 5-iron and a 3-wood (driver). From the figures, it can also be seen that the loft of the club, i.e. the amount the face is tilted back from the vertical, is larger for the 9-iron in comparison with the 5-iron which, in turn, has more loft than the driver. The more loft, the higher and shorter will be the flight of the ball.

Figure 2:
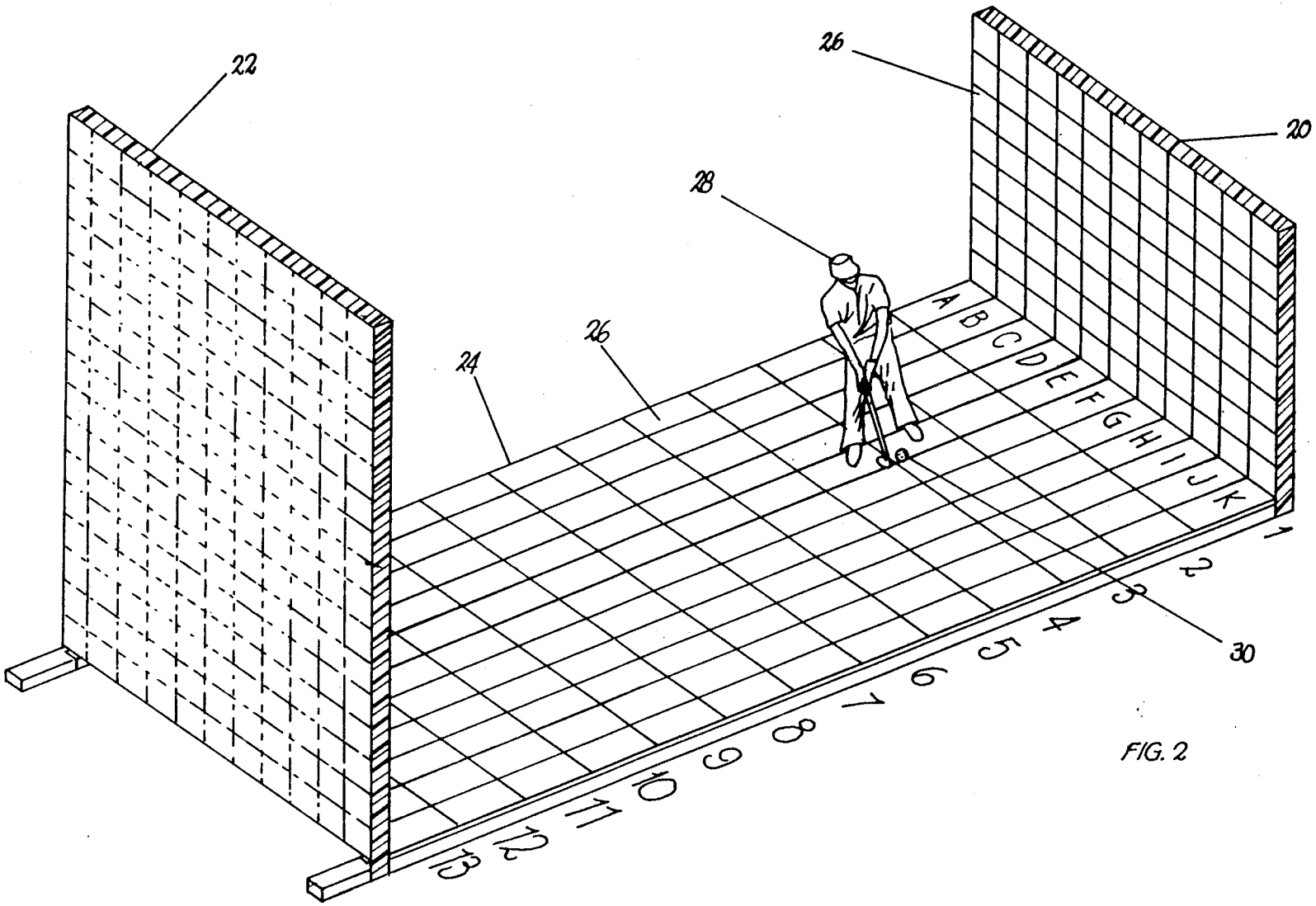
FIG. 2 is a perspective view of a training facility in accordance with the invention, showing a golfer addressing a ball with an approach club.

FIG. 2 shows a typical training facility in accordance with this invention, to be used with a hollow polyolefin, i.e. polypropylene or polyethylene, ball. The front and rear walls, 20 and 22 respectively, are parallel, and located at a distance of about 30 feet from each other. The floor 24 may be of grass, synthetic grass, wood r concrete, etc., and ought to be relatively flat, so as to provide a comfortable stance. The width of the floor ought to be about 10–15 feet. The front wall ought to be about 10 feet high and the rear wall about 15 feet high. However, these figures are approximate only, and may be subject to all kinds of variations. There is no need for a ceiling, but one may serve the purpose of stopping the ball from leaving the facility. The walls are suitably marked with squares or rectangles, forming a coordinate system.

The golfer 28 is hitting a plastic ball 30 against the front wall with a 9-iron. The ball rises very quickly with this club. For this reason, the player must stand close to the front wall, or else he will hit the ceiling or, if outdoors, the ball will fly over the front wall.

Figure 4:
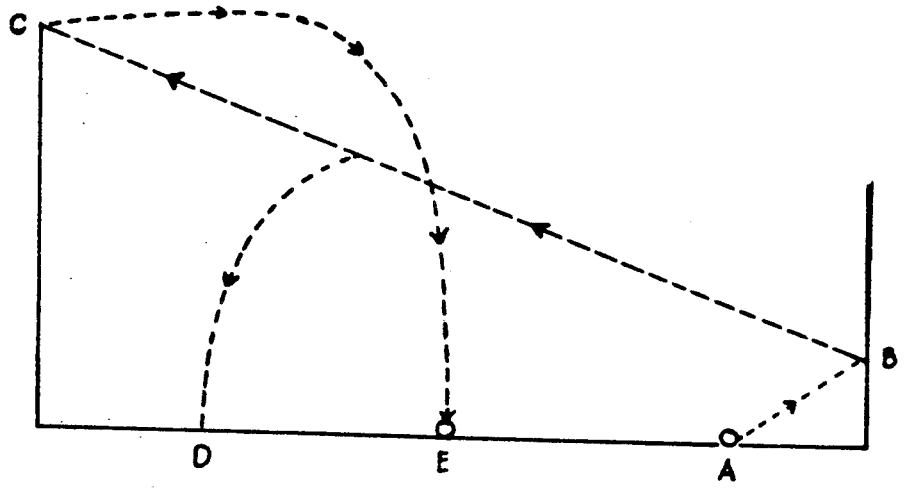
FIG. 4 is a sectional view of the path of the ball, hit with an approach club, such as a no. 9 iron.

In FIG. 4, the trajectory of the shot is shown. The ball is first located at A, on the ground or on a teeing peg, in front of the player. When hit the ball will rise, more or less, along the line A–B, hitting the front wall at B, from which point it will follow the trajectory B–C, hitting the rear wall at point C, provided the hit was good. A ball hit by a beginner or a not so ardent golfer will lose its velocity before reaching C, and drop to the ground at, for instance, D. On the other hand, a good golfer will hit the ball hard enough for it to bounce back from C, towards the front wall, and drop down, for instance, at E.

Figure 3:
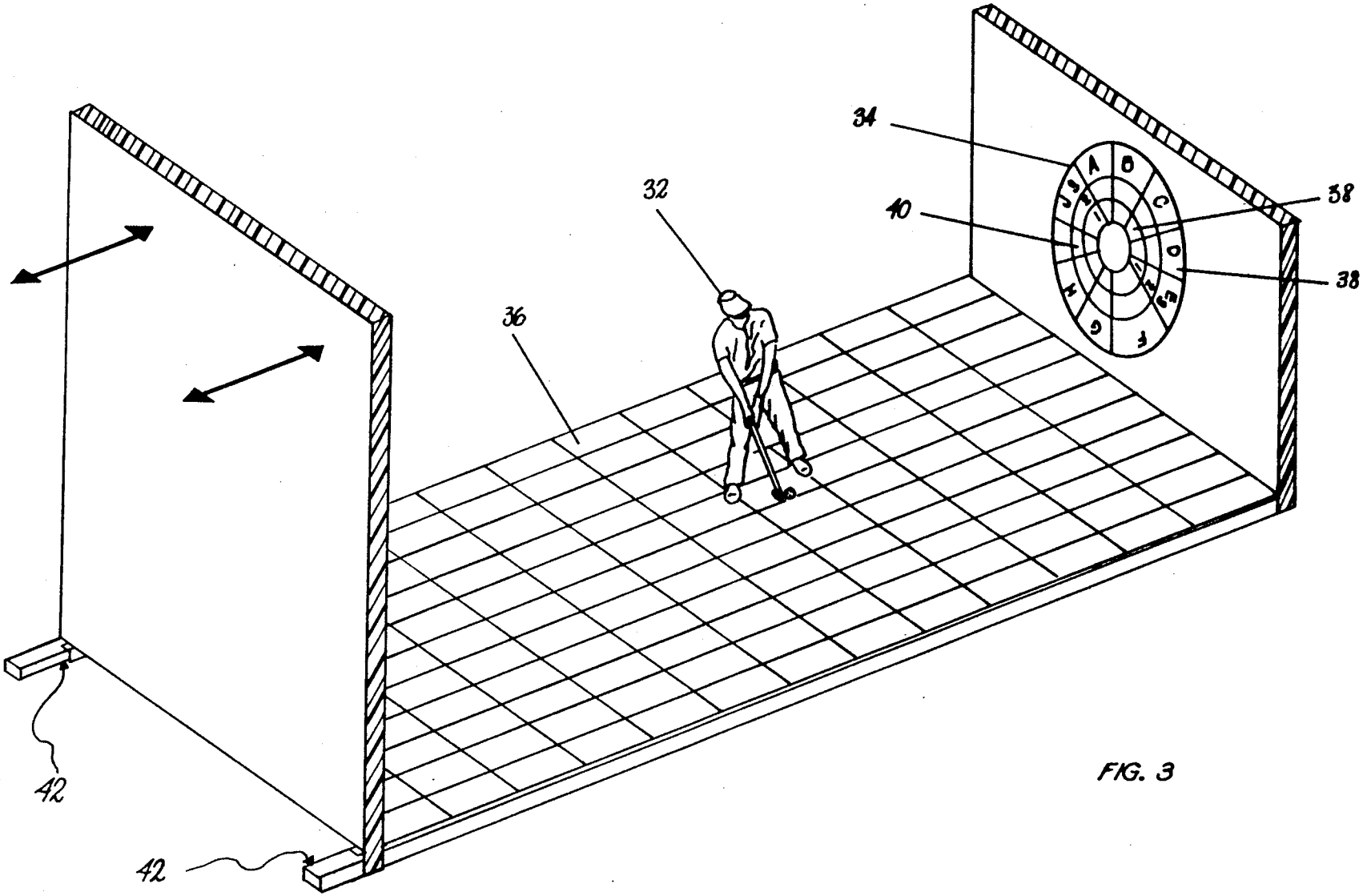
FIG. 3 is a perspective view of a training facility in accordance with the invention, with a golfer addressing a ball with a driver.

In FIG. 3, a golfer 32 is shown hitting a ball with a driver. The loft of this club is considerably smaller, some 10 degrees, which gives a much lower trajectory. For this reason, the golfer does not have to stand as close to the front wall, as he has to with an approach club. A point in the center, or even in the rear half of the court is adequate. The front wall carries a polar grid 34; the back wall is shown with no grid; the floor with a grid of rectangles 36. Spaces in the polar coordinates are distinguished from each other by the use of color, e.g. alternate rings colored red 38 and white 40, and/or by means of letters and numerals. Means 42 are diagramatically indicated for moving the back wall towards or away from the front wall as may be desired by individual golfers.

Figure 5:
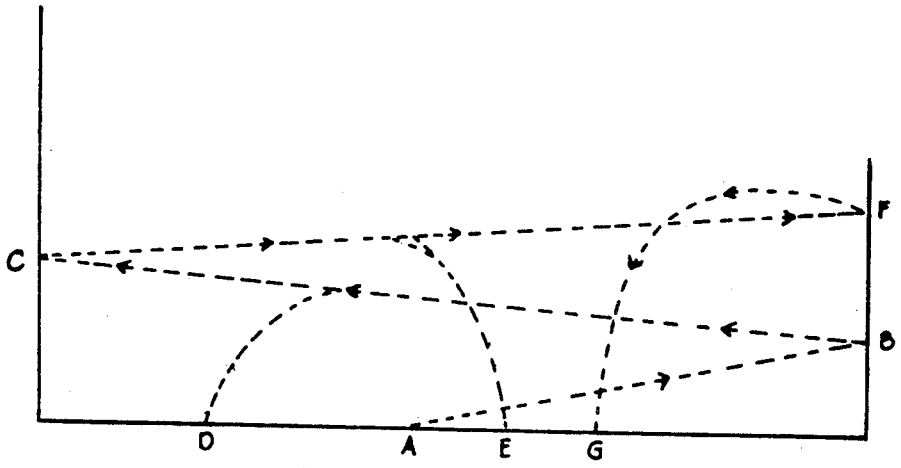
FIG. 5 is a sectional view of the path of a ball, hit with a long iron or a wood.

The trajectory is shown in FIG. 5. The ball is originally located on the ground or on a teeing peg in front of the golfer, at A. When hit, it rises along a less steep trajectory A–B, hitting the front wall at point B, from where it bounces back along the line B–C. A beginner will, probably, not be able to generate sufficient clubhead speed to make the ball hit the rear wall. Instead, it will drop somewhere between B and C, for instance at D. A good golfer will be able to hit the rear wall at point C, and his ball may bounce back towards the front wall, dropping, for instance, at point E. A very good golfer may be able to hit the ball so hard that it bounces back to the front wall, hitting it at point F, where it bounces back, dropping, for instance, at point G. However, the distance between the front and the rear walls ought to be long enough so as to make such a shot impossible for anybody but a golfer with a zero or plus handicap.

The exact location of points B and C, and F if desired, may be determined by its coordinates, i.e. the particular space hit by the ball, either by sight or by electrical means. With just a short time in the facility the golfer develops a keen sense of the quality, i.e. the direction and distance of the shot by watching the flight of the ball.

Figure 6:
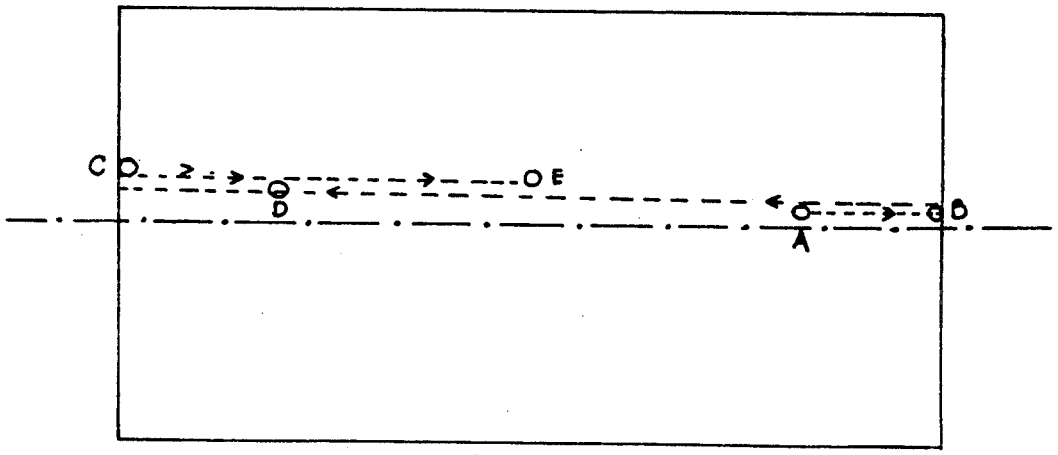
FIG. 6 is a top view of the path of the ball, shown in FIG. 4.
Figure 7:
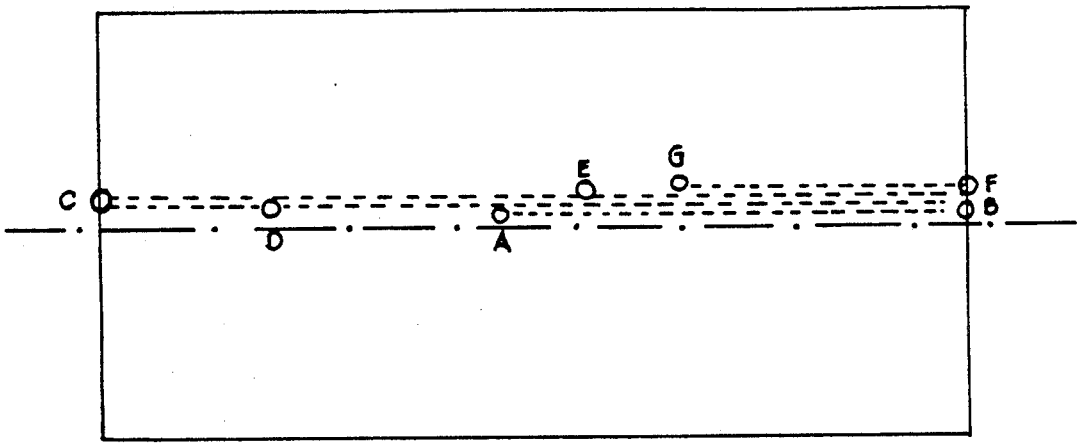
FIG. 7 is a top view of the path of the ball, shown in FIG. 5.

FIG. 6 and 7 are top views of the flights of the balls shown in FIG. 4 and 5, which are assumed to have been straight hits, parallel with the longitudinal axis of the training facility. While the aim is to hit the ball along this line, most golfers will probably hit the ball to the left or the right of this axis.

Figure 8:
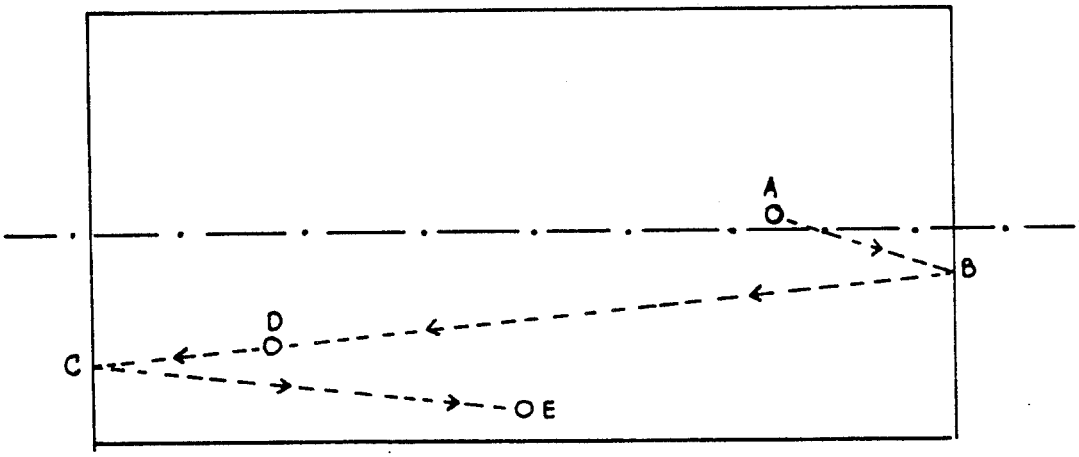
FIG. 8 is a top view of the path of a ball hit towards a square to the right of the axis of symmetry of the facility, from the golfer position shown in FIG. 2.
Figure 9:
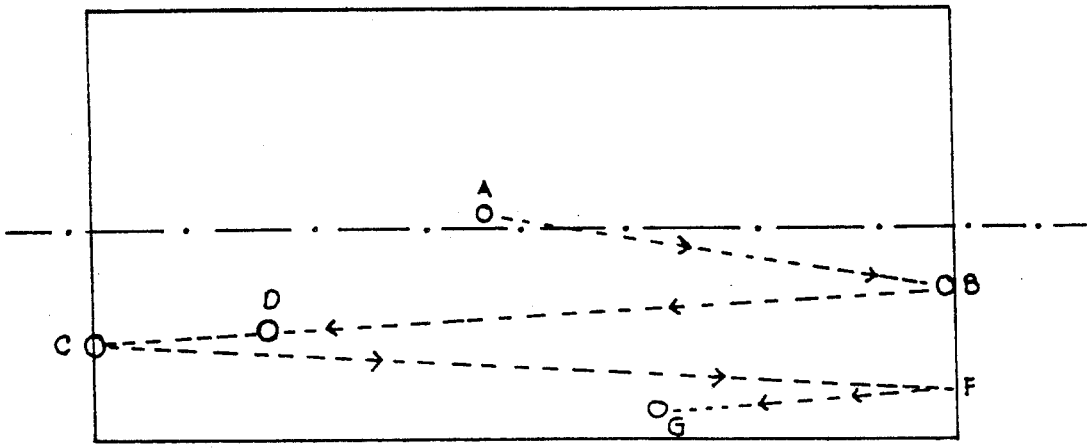
FIG. 9 is a top view of the path of a ball hit towards a square to the right of the axis of symmetry, from the golfer position shown in FIG. 3.

FIG. 8 and 9 show trajectories of the balls hit in FIG. 4 and 5, the shot having been hit to the right of the longitudinal axis. By adding spin to the ball, all sorts of trajectories may result, just as on a real golf course.

When the golfer hits the ball, he does it in the same manner as on the golf course. Rather than looking up, to see the result of his shot—a habit that often spoils the shot—he or she is encouraged to turn the head backwards (to the right for right handed golfers), to see the bounce of the shot. This turning of the head enhances the swing, and is recommended by one of the foremost teachers of the game, Paul Bertholy, in his book "The Bertholy Method".

The result of the shot becomes known instantly, both as regards direction and distance. A bad shot will deviate from the longitudinal axis, and hardly go back to the rear wall. A good shot will go straight back to the rear wall and bounce back a short distance, while a really good shot will bounce back a large distance from the rear wall. The instant feedback will reinforce the action. The practicing golfer will instantly know whether the shot was good, very good or excellent, all from observing the flight of the ball, without even lifting his head. In such a manner, action leading to bad shots will be avoided, and action resulting in good shots instantly repeated until the particular feel, leading to good shots, becomes part of the swing. As a result, most shots will be good shots.

The facility may be used by golfers of all levels of skill, from beginners to professional golfers. The beginner will use the facility to practice what he learned during his last lesson. To start with, hitting the ball straight towards the wall, and hard enough to make it bounce back. As he progresses, he will learn to use all the clubs in his bag, eventually making the ball bounce back to the rear wall. At this stage, he is ready to play on a golf course.

Seasoned golfers do also take lessons, and they will be able to practice in a better manner in a facility in accordance with the invention, than on a regular practice ground, because of the instant feed back and re-inforcement of the lesson, leading to better shots.

Of particular value is the opportunity to practice golf during the off season. In addition to practicing the swing, golfers may use the facility for playing games, for instance in the following manner:

Each player hits shots, starting with the driver, continuing with fairway woods and irons, etc., until reaching the green. The location of the shots on a simulated golf course may be determined by the square it hits on the rear wall, as well as its position on the ground, which could also be provided with a square or polar coordinate system. A table may be prepared, setting out the relationship between the coordinates of each shot with the position of the ball on the corresponding fairway on the simulated golf course. This relationship may also be computerized, to various degrees of sophistication. Thus the location and the force of the bounce of the ball on the rear wall may be measured electrically and translated instantly into a location on an electronic picture of a fairway, which may be displayed on a screen on one of the side walls. In order to complete each hole, a simulated putting green with a cup of rubber, plastic or metal of the kind available in the market could be added to the facility. Many facilities could be grouped into special buildings, where many people may be able to practice golf.

A golf training complex may be made up of two or more of the training devices of this invention, supplemented by simulated or real putting greens. It could also be supplemented by appropriate approaches, including hazards, to the greens. A regular full golf course may have added one or a plurality of the training facilities, which can be used while waiting to tee up, or during inclement weather.

A useful adjunct to the invention would be training aids, such as a nearby room with books and video displays of lessons. A video screen displaying a lesson could be in a side wall faced by the golfer as he prepares to swing.

Figure 10:
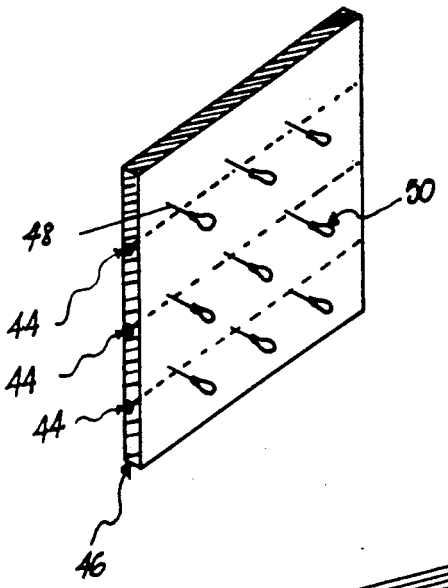
FIG. 10 is a sectional view of a portion of a wall adapted with a display to show the location of a hit.

In FIG. 10, a diagramatic perspective view of the back side of a portion 46 of a wall is shown, i.e. the ball will strike the side of the wall hidden from the viewer of the drawing. In this case the wall, or at least the surface struck by the ball, is made of a tough transparent plastic. Grid markers 44 are on or under the surface. Sensors 48 are diagramatically shown connected to lights 50. When the ball strikes a grid space the sensor causes the light to turn on, and it is visible to the golfer through the clear plastic wall or a port to the clear plastic surface, thus informing the golfer of the location of the hit.

FIGS. 11A and 11B are simplified diagramatic representations of a device to supply a fresh ball on a tee after a teed ball has been driven by the golfer. Tube 52 is buried vertically in the floor 54. Tee carrier 56 is moved up and down within the tube 2 on rod 58, e.g. in response to the drive of the ball (by means not shown). After the ball 60 in the up position (FIG. 11A) has been driven, tee carrier 56 is retracted (FIG. 11B). Reservoir 64 is spring-loaded with balls 70. Tee 62 (which may be made of rubber) remains in position in tee carrier 56, a fresh ball is pushed into position on the tee, and the whole is then raised to the up position ready for the next drive, as in FIG. 11A.

Figure 12:
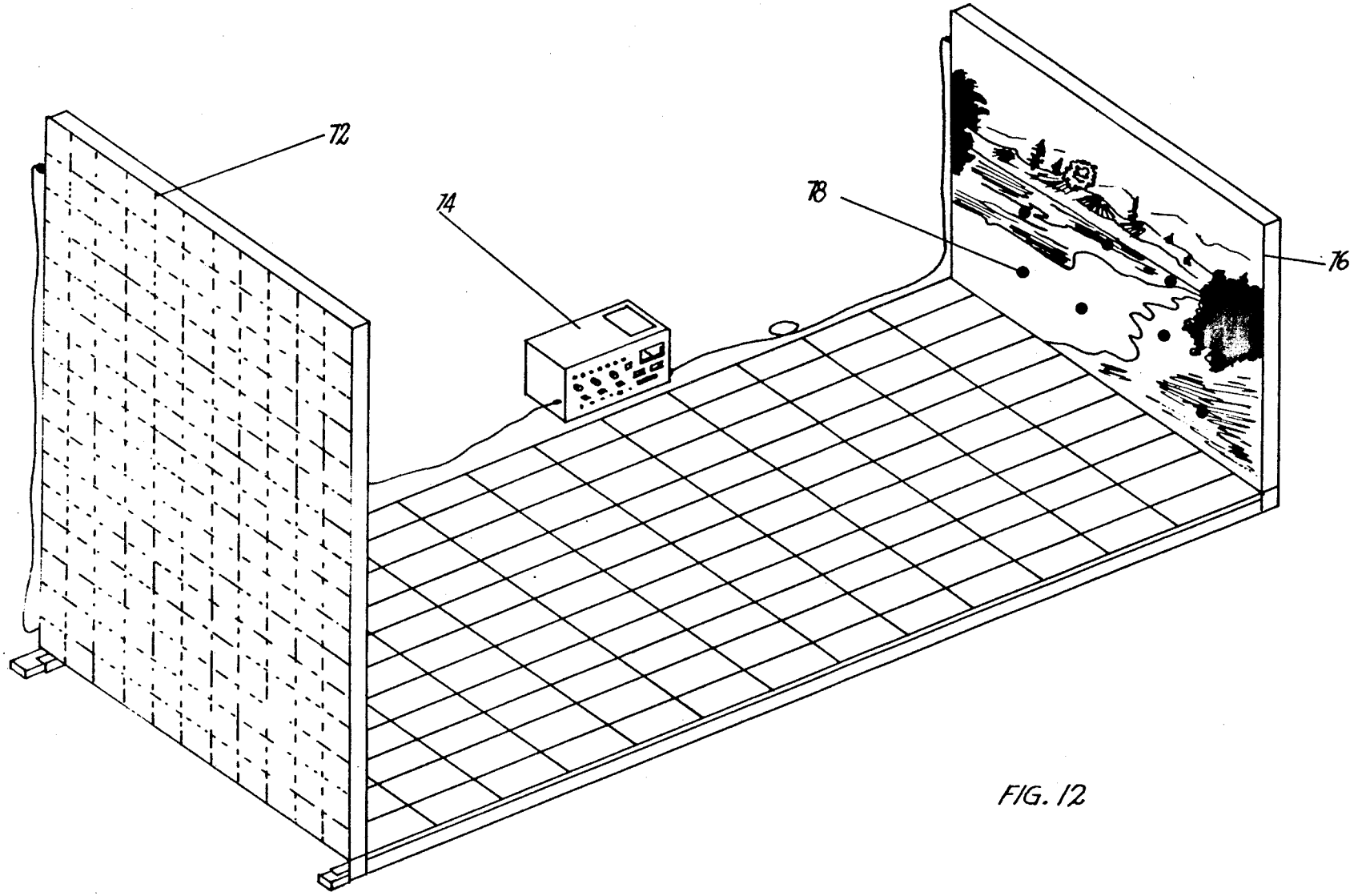
FIG. 12 is a perspective view of the rear wall, a display of a simulated fairway, and a computer to translate the location and force of bounce off the rear wall to a corresponding location on the fairway.

FIG. 12 shows diagramatically interconnected rear wall 72, computer 74, and display 76 carrying a depiction of a fairway. The computer translates the location and force of a ball striking the rear wall into a corresponding location where a real golf ball so driven would have landed on a real golf course. This is shown on display 76 as by lights 78. In order not to confuse the drawing only a few lights are shown, but normally there will be a light corresponding to each grid space. While the display 76 is shown on the front wall, it obviously can be placed anywhere and can be of any size that will be readily visible to the golfer.

Figure 13:
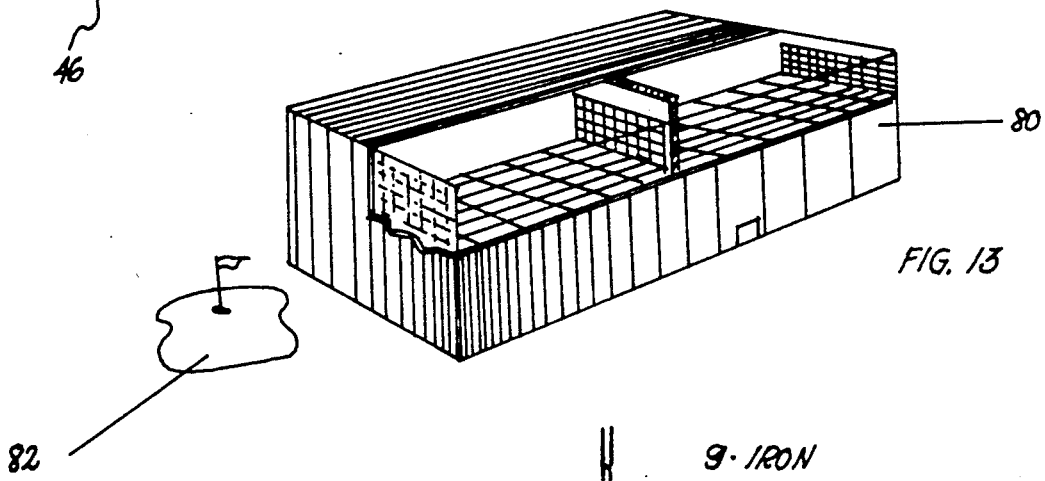
FIG. 13 is a cut-away perspective view of a building containing a plurality of training devices of the invention and a putting green adjacent thereto.

FIG. 13 is a schematic indication of a building 80 which may contain one or a plurality of the golf training devices, and an artificial or natural putting green 82 nearby to be utilized in connection with the invention as described earlier.

I claim:

1. A golf training device comprising:

a front wall;

a rear wall opposite and substantially parallel thereto;

each wall marked by a grid on the side facing the other wall; and a light training ball, intended to be hit to the front wall by a golfer standing between the walls.

2. A device according to claim 1 wherein the walls are spaced apart a distance such that the training ball, when hit by a well-executed shot, will bounce off the front wall, then the rear wall.

3. A device according to claim 2 wherein the ball is a hollow plastic ball the approximate size, of a golf ball, and wherein said distance is approximately 30 feet.

4. A device according to claim 1 wherein the floor between the walls is also marked by a grid.

5. A device according to claim 4 wherein the grids are square.

6. A device according to claim 1 wherein the grids are rectangular, or square.

7. A device according to claim 1 wherein the grids are polar.

8. A device according to claim 1 wherein spaces on a grid are distinguished from each other, as by numbers, letters, and/or colors.

9. A device according to claim 1 wherein the floor between the walls is marked to show one or more positions at which a golfer is to stand.

10. A device according to claim 1 provided with means to indicate that a grid space has been struck by a ball.

11. A device according to claim 1 provided with means to supply, after each shot, a fresh ball on a tee.

12. A device according to claim 1 provided with means to translate the location and force of the bounce of the ball off the rear wall into a location on a simulated fairway, and means for indicating said location on a display of said fairway.

13. A device according to claim 1 wherein the distance between the walls is about one-third of the distance a light plastic ball will travel in the air if hit with a driving club by a scratch golfer.

14. A device according to claim 1 wherein the distance between the walls is adjustable.

15. A method for training golfers by instantaneous feedback of trajectory, including direction and distance, of a light practice ball struck by the golfer, which comprises providing to the golfer a training device according to claim 1, and teaching the golfer to observe the location where the ball strikes the front wall and/or the back wall and/or the floor.

16. A golf training complex comprising a plurality of devices according to claim 1.

17. A golf training complex according to claim 16 also comprising one or more putting greens or simulated putting greens.

18. A gold training device comprising:

a front wall;

a rear wall opposite and substantially parallel thereto;

each wall marked by a grid on the side facing the other wall;

said walls being spaced apart by a distance such that a light practice ball, when a golfer standing between the walls hits a well-executed shot towards the front wall, will bounce off the front wall, then the rear wall.

19. A method for a golfer to improve his/her swing which comprises:

standing before a front wall marked by a grid;

hitting with a golf club a light practice ball against the front wall with normal golfing force such that the ball bounces off the front wall towards and hopefully striking an opposite rear wall marked by a grid;

observing the location(s) where the ball strikes the front wall and/or the rear wall and/or where it falls to the floor, thereby receiving instantaneous feedback on the quality of the shot; and repeatedly carrying out the above steps with the objective of establishing a swing that gives a high and consistent quality of shot.

20. A method according to claim 19 wherein the floor between the walls is marked by a grid.

21. A gold training device comprising:

a front wall;

a rear wall opposite and substantially parallel thereto;

a light training ball located at a position on the floor between the walls, to be hit to the front wall by a golfer standing between the walls; and at least one golf club;

wherein the walls are spaced apart a distance such that the training ball, when hit from said position by a well-executed shot with said club will bounce off the front wall, then the rear wall and provide instantaneous feedback to the golfer on the quality of the shot.

22. A device according to claim 21 wherein the ball is supported on a tee.

23. A device according to claim 21 wherein the rear wall is marked by a grid on the side facing the front wall.

24. A device according to claim 21 wherein the rear wall is higher than the front wall.

25. A method for a golfer to improve his/her swing which comprises:

standing before a front wall;

hitting with a golf club a light practice ball against the front wall with normal golfing force such that the ball bounces off the front wall towards and hopefully striking an opposite rear wall;

observing the location(s) where the ball strikes the front wall and/or the rear wall and/or where it falls to the floor, thereby receiving instantaneous feedback on the quality of the shot; and repeatedly carrying out the above steps with the objective of establishing a swing that gives a high and consistent quality of shot.

* * * * *